US010221010B2

(12) United States Patent
Reeb et al.

(10) Patent No.: US 10,221,010 B2
(45) Date of Patent: Mar. 5, 2019

(54) LOCKING DEVICE FOR CONTAINER

(71) Applicant: SERIO-US INDUSTRIES, INC., Baltimore, MD (US)

(72) Inventors: David L. Reeb, Sykesville, MD (US); James L. Martin, II, Gambrills, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 0 days.

(21) Appl. No.: 15/589,260

(22) Filed: May 8, 2017

(65) Prior Publication Data

US 2017/0320666 A1 Nov. 9, 2017

Related U.S. Application Data

(60) Provisional application No. 62/332,762, filed on May 6, 2016.

(51) Int. Cl.
*B65F 1/16* (2006.01)
*E05B 15/00* (2006.01)
(Continued)

(52) U.S. Cl.
CPC ..... *B65F 1/1615* (2013.01); *B65F 1/1646* (2013.01); *E05B 15/0093* (2013.01); *E05B 17/2007* (2013.01); *E05B 65/5292* (2013.01); *B65F 2210/148* (2013.01); *B65F 2210/168* (2013.01)

(58) Field of Classification Search
CPC ..... B65F 1/1615; B65F 1/1646; B65F 2210/168; B65F 2210/148; B65F 1/16; E05B 65/5292; E05B 17/2007; E05B 65/52; E05B 15/0093; Y10T 70/554; Y10T 292/11; Y10T 292/14; B65D 50/068; B65D 55/14; B65D 2313/04; B65D 43/26
USPC ... 70/63, 135, 139, 158–163, 165–173, 276, 70/386; 292/251.5, 252, 230–234, 292/236–238, DIG. 4, DIG. 22, 194, 195,
(Continued)

(56) References Cited

U.S. PATENT DOCUMENTS 4,346,924 A * 8/1982 Herriott ..... E05B 65/5292 206/1.5
4,714,286 A * 12/1987 Yamamoto ..... A45C 5/00 292/252
(Continued)

FOREIGN PATENT DOCUMENTS

DE 19708193 C2 * 3/1999
DE 102007039351 A1 * 11/2008
WO WO 2005/111348 * 11/2005

*Primary Examiner* — Lloyd A Gall
(74) *Attorney, Agent, or Firm* — Berenato & White, LLC

(57) ABSTRACT

The present invention generally relates to locking devices for waste containers, particularly residential or commercial waste containers. The present invention also relates to a waste container having a locking device which keeps the container closed when a sudden jerking or jarring, such as ground impact, is applied on the container, but allows the container to be opened during the dumping or tipping process. The locking device contains an impact detecting paddle or rolling member to provide a mechanical impact sensor that can detect whether the container has been unintendedly tipped over in the forward direction or whether it is being tipped over, such as for dumping.

20 Claims, 19 Drawing Sheets

(51) Int. Cl.
*E05B 65/52* (2006.01)
*E05B 17/20* (2006.01)

(58) Field of Classification Search
USPC ..... 292/197, 198, 200, 130–132, 344; 220/210, 324, 908, 326, 230, 260
See application file for complete search history.

(56) References Cited

U.S. PATENT DOCUMENTS

| | | | | | |
|---|---|---|---|---|---|
| 4,865,368 | A * | 9/1989 | McCall | E05B 65/5292 | 150/101 |
| 5,094,358 | A * | 3/1992 | Serio, Sr. | E05C 3/048 | 220/315 |
| 5,224,744 | A * | 7/1993 | Michelutti | B65F 1/1615 | 220/908 |
| 5,474,341 | A * | 12/1995 | Putman | B65F 1/1615 | 220/315 |
| 6,666,485 | B1 * | 12/2003 | Moret | B65F 1/1615 | 220/315 |
| 9,580,243 | B2 * | 2/2017 | Reeb | B65F 1/1646 | |
| 9,580,244 | B2 * | 2/2017 | Reeb | B65F 1/1615 | |
| 2014/0020436 | A1 | 1/2014 | Matuschek | | |
| 2015/0035288 | A1 | 2/2015 | Fink et al. | | |
| 2016/0200509 | A1 * | 7/2016 | Matuschek | E05C 3/124 | 292/242 |

* cited by examiner

LOCKING DEVICE FOR CONTAINER

CROSS-REFERENCE TO RELATED APPLICATIONS AND CLAIM TO PRIORITY

This application claims the priority of U.S. Provisional Patent Application No. 62/332,762, filed May 6, 2016, the disclosure of which is incorporated herein by reference.

FIELD OF THE INVENTION

The present invention generally relates to locking devices for waste containers, particularly residential or commercial waste containers. The present invention also relates to a waste container having a locking device which keeps the container closed when a sudden jerking or jarring, such as ground impact, is applied on the container, but allows the container to be opened during the dumping or tipping process.

BACKGROUND

Household refuse such as trash, recycling items, and/or yard waste can typically be deposited in a container. Such containers can include a lid for concealing the household refuse collected therein, as well as to prevent wild animals or people from accessing the household refuse and also protecting the trash from the elements. Typically, the lid is removably coupled to the container in a friction-fit manner to allow the lid to be easily removed from the container. However, when the lid is not secured, the contents can be undesirably expelled from the container, such as if the container is toppled over such as by wind or animals.

Various lid locking devices have been implemented for refuse containers. For example, U.S. Patent Application Publication No. 2014/0020436 to Matuschek discloses a lock that opens automatically by tipping of a refuse container as the result of gravity. In addition, the lock may also be opened by rotating a locking cylinder, the locking cylinder disposed in the lock housing. This lock, however, may also be opened when the refuse container falls forward accidentally, e.g. by wind or animals. Such accidental knock-over of the refuse container also expels its contents, which is undesirable.

Therefore a need exists for a locking device that improves upon prior locking devices.

SUMMARY OF THE INVENTION

It is the object of the present invention to further develop a refuse container lock in a manner advantageous to the user.

The object is fulfilled by means of the invention set forth in the claims.

As a result of the inventive solution, the locking cylinder is no longer incorporated in the counterlocking part. The counterlocking part can thus be of simpler configuration. It becomes possible to dispense with an independent housing, in which a locking cylinder is incorporated in the counterlocking part, because the locking cylinder is situated inside the lock housing.

As a result of the inventive solution, intervention in the mechanism that has proven itself in the lock can be kept to a minimum. The latch head receives an additional arm, on which the locking cam acts. The latch tail can therefore be rotated by a gravity-powered opening slide upon tipping of the lock housing. With the lock housing in the upright position, the latch tail is kept in a position that holds the latch in the closed position. When the locking cylinder is actuated, the latch head is pivoted with respect to the latch tail. It thereby reaches a release position in which the lid of the upright-standing refuse container can be opened. The elastic return force can be generated by a pressure spring connected with the latch body. The return force holds a stop of the latch head against a counterstop of the latch tail. When opening is actuated by tipping of the refuse container lock, the latch behaves like a rigid body. The pre-compressed spring, however, is compromised if the refuse container lock is intended to be opened by actuation of the locking cylinder. Then the latch head pivots with respect to the latch tail, which is held stationary. In a preferred embodiment, the refuse container lock has an actuation slide. The slide is moved upon actuation of the locking cylinder by the locking cam. The locking cam thus acts directly on the actuation arm. The actuation arm moves at an angle to a locking arm on whose end a bolt stud can be situated that, in closed position, catches behind the hook of the counterlocking part. In a preferred embodiment, the two arms of the latch head run essentially diagonally to one another. The pivot axis about which the latch rotates upon tipping of the lock housing is preferably connected immovably with the lock housing. The two bearing shells, which configure the lock housing, can comprise bearing openings for this purpose. The pivot axis about which the latch head can pivot with respect to the latch tail, is preferably in the immediate vicinity of the rotary axis. The actuation slide and opening slide can be movable in parallel with one another. Both slides are fed through the lock housing. For this purpose, the two housing shells can comprise guide ribs or guide grooves. The actuation slide can be directly impacted by the eccentric cam. The actuation slide is preferably displaced against the force of a return spring. The actuation slide can comprise a pocket into which the free end of the actuation arm engages.

In certain embodiments, an impact detecting paddle or rolling member may be detachably mounted in a recess of the shell. The paddle or rolling member provides a mechanical impact sensor that can detect whether the container has been unintendedly tipped over in the forward direction or whether it is being tipped over, such as for dumping. When the container is unintentionally knocked over, the jerking or jarring action, such as ground impact, on the container actuates the paddle or rolling member such that it is detached or partially detached from the recess. In that detached or partially detached position, the paddle or rolling member blocks the opening slide from sliding upwardly into the release position. The paddle or rolling member prevents opening of the container, when the waste container falls over and impacts the ground in any direction.

Further aspects of the invention are disclosed in the Figures and are described herein.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DETAILED DESCRIPTION

Figure 1:
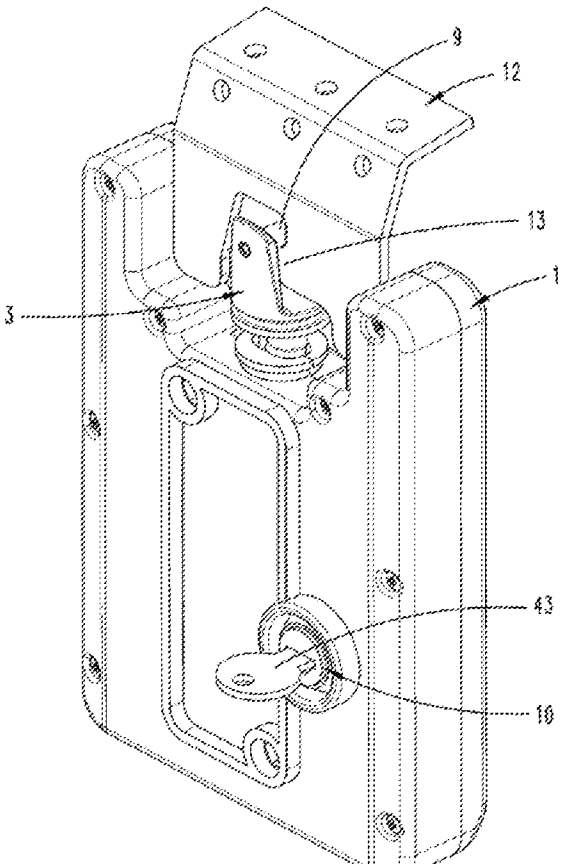
FIG. 1 shows an assembled refuse container lock with associated counterlocking part, in a perspective view.

For purposes of the following description, certain terminology is used in the following description for convenience only and is not limiting. The characterizations of various components and orientations described herein as being "vertical", "horizontal", "upright", "right", "left", "side", "top", or "bottom" designate directions in the drawings to which reference is made and are relative characterizations only based upon the particular position or orientation of a given component as illustrated. These terms shall not be regarded as limiting the invention. The words "downward" and "upward" refer to position in a vertical direction relative to a geometric center of the apparatus of the present invention and designated parts thereof. The terminology includes the words above specifically mentioned, derivatives thereof and words of similar import.

Figure 18:
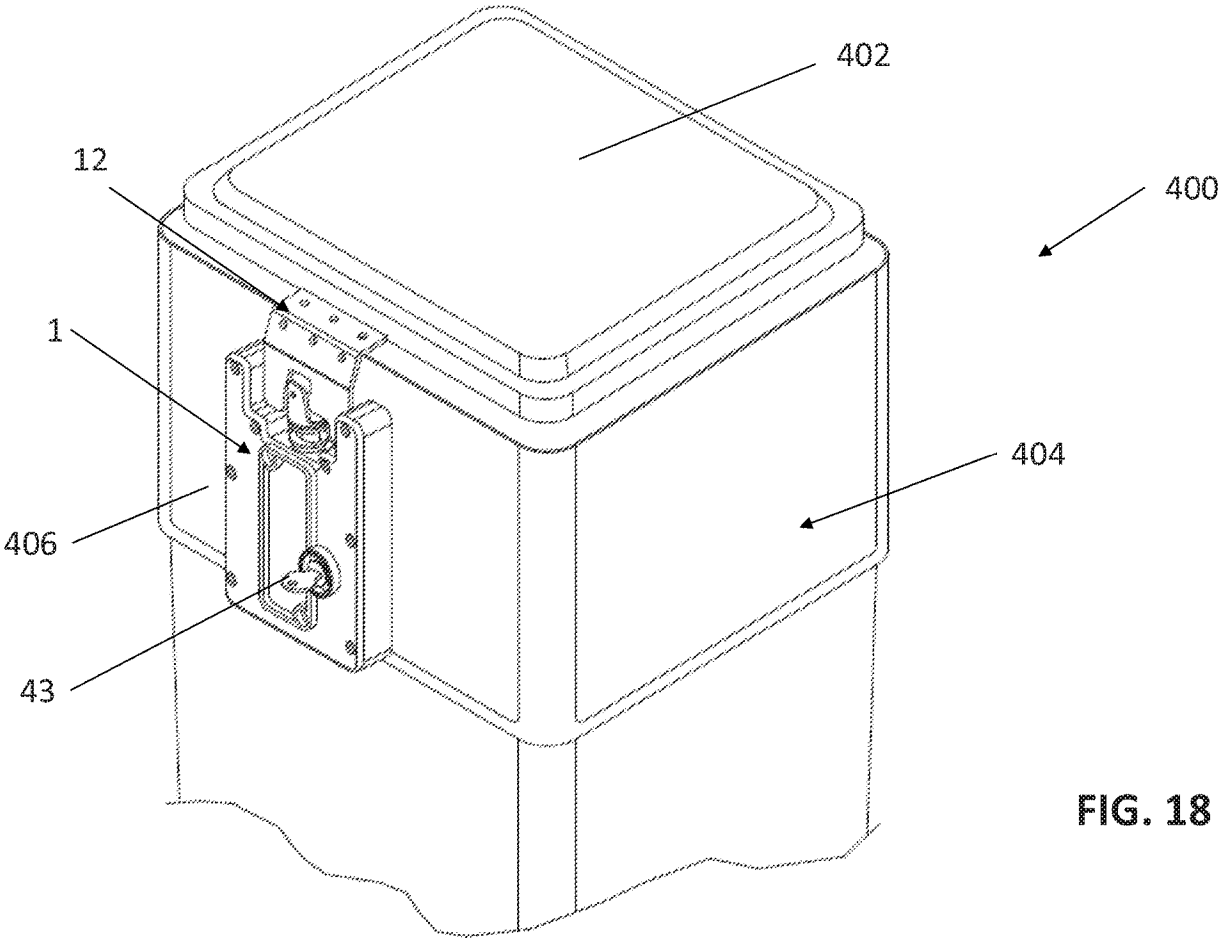
FIG. 18 shows a fragmentary perspective view of a container with a locking device according to an exemplary embodiment of the present invention attached to the outside thereof.

As shown in FIG. 18, a container 400 according to an exemplary embodiment of the present invention is illustrated. The container 400 may be a refuse container such as a household refuse container for various items including trash, recycling, and/or yard waste. However, the container 400 may be used to accommodate any type of article and may have any shape. For example, the container 400 may be cylindrical or polygonal. In addition, the container 400 may be made of various materials, such as plastic, metal, or a combination thereof. The container 400 includes a lid 402 and a containment body 404. The containment body 404 defines an interior volume for holding, e.g., waste. The lid 402 may be pivotally mounted to the containment body though one or more couplings, such as a hinge. The containment body 404 may include a plurality of side walls 406. The lid 402 and the containment body 404 of container 400 may be made of the same or different materials. In an exemplary embodiment, wheels (not shown) may be coupled to the containment body 404 to aid in transport of the container 400.

Figure 5:
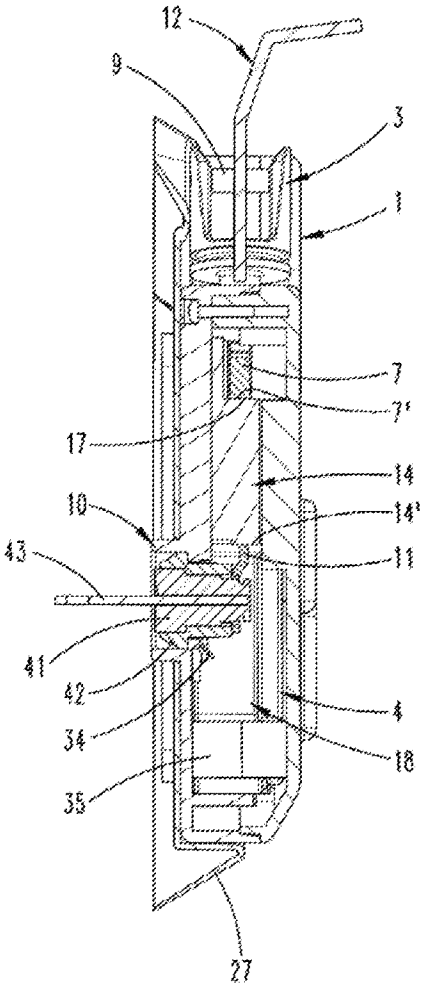
FIG. 5 shows a section along the line V-V in FIG. 4.
Figure 19:
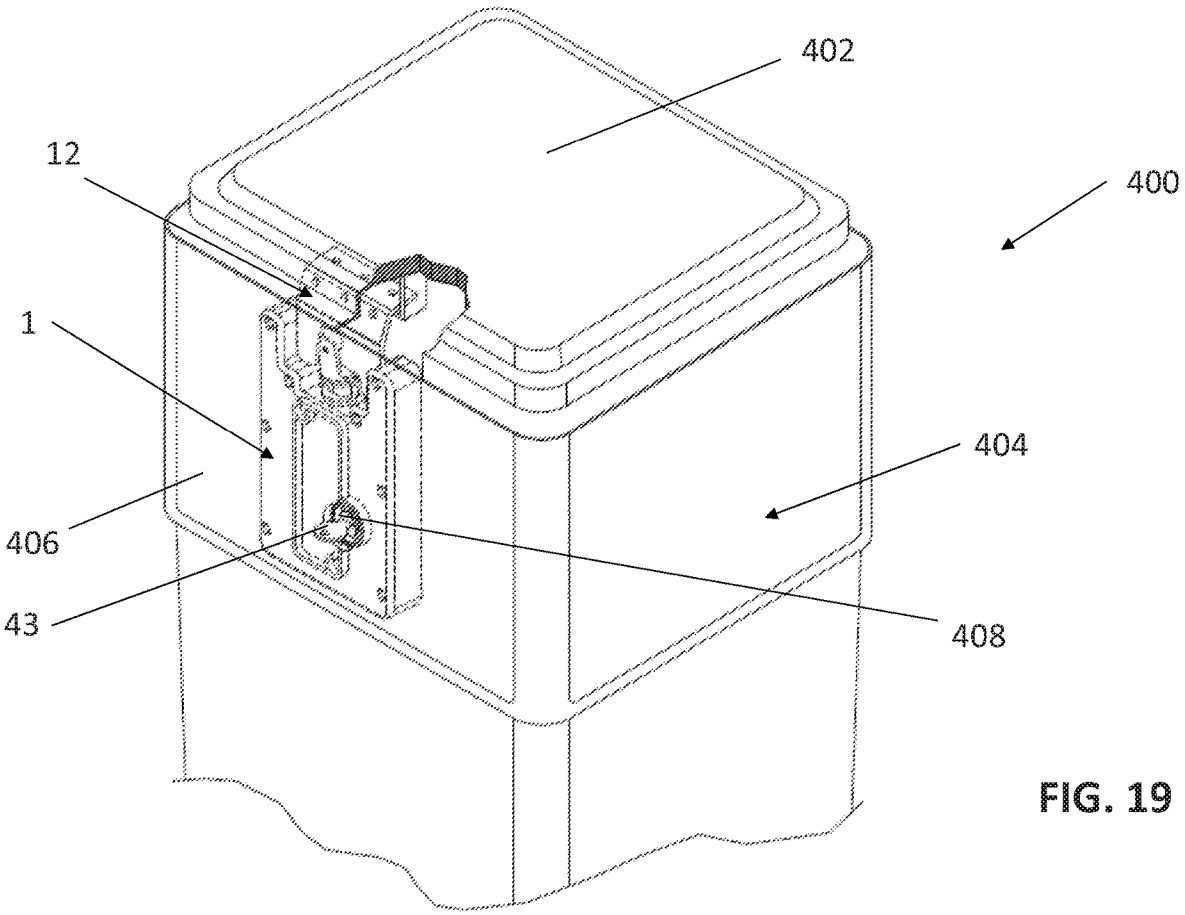
FIG. 19 shows a fragmentary perspective view of a container with a locking device according to an exemplary embodiment of the present invention attached to the inside thereof.

The lock housing 1, as best shown in FIG. 1, contains two housing shells 28, 29 made of plastic or other suitable material. The housing 1 can be attached to the outside a side wall 406, preferably a front side wall, of a refuse container 400, e.g. by fasteners or an adhesive attaching the shell 29 to the refuse container. Although FIG. 18 shows the lock housing 1 attached to the outside of the container 400, it is also possible to attach the lock housing 1 inside the container 400, as shown in FIG. 19, with just the cylinder core 41 accessible through a hole 408 in the side wall 406 of the container 400. The hole 408 allows a key 43 to be inserted into the key slot of the cylinder core 41 to open the container 400. When mounted on the inside of the container, as illustration in FIG. 19, the shell 28 may be attached to the inside of the side wall 406. Alternatively, a cover 27 (as best shown in FIG. 5) may be attached, as an intermediate layer, to the inside of the side wall 406 and the shell 28 is then attached to the cover 27.

The shell 28 has a locking cylinder bearing opening 33, into which a cylinder housing 42 may be inserted. The cylinder bearing opening 33 is preferably not round in shape, so that the cylinder housing 42 may be non-rotatably held in the opening 33. Situated in a housing cavity of the cylinder housing 42 is a cylinder 10 containing a cylinder core 41 which cannot be rotated with respect to the cylinder housing 42 when the key 43 is not inserted therein. The cylinder core 41 does not allow itself to rotate with respect to the cylinder housing 42 until the key 43 has been inserted into the key slot of the cylinder core 41.

A locking cam 11 is situated on an end portion of the cylinder core 41 opposite the key slot. The locking cam 11 forms a lobe 302 that non-rotatably connects to the cylinder core 41. The cylinder housing 42 has grooves 44 into which a retaining clamp 34 can be inserted, the clamp holding the cylinder housing 42 on the bearing shell 28.

The two shells 28, 29 have guide ribs 37, 38, 39, 40 in their bearing cavities. Between the guide ribs 37 and 38 there is an opening slide 18, which is slidable inside the lock housing 1 in a direction parallel to the guide ribs 37 and 38 (up and down in the figures). Parallel to the motion direction of the opening slide 18, an actuation slide 14 is mounted between the guide ribs 39 and 40, and is slidable in a direction parallel to the motion direction of the opening slide 18.

The opening slide 18 is freely slidable within the lock housing 1, which means that it may slide from an upright position to a tipped position by gravity acting on it during tipping of the lock housing 1. The opening slide 18 is in the upright position when the lock housing 1 is upright, and in the tipped position when the lock housing 1 is inverted, e.g. when the refuse container in tipped for dumping. The actuation slide 14 is held in a defined operating position by a spring 15 supported on the lock housing 1. The spring biasing the actuation slide 14 toward the locking cam. A bottom side 14' of the actuation slide 14 is supported on the locking cam 11. The spring 15 situated opposite the bottom side 14' pushes the actuation slide 14 against the locking cam 11.

A latch 2 is located inside the lock housing 1, and contains a latch tail 4 and a latch head 3. The latch tail 4 contains a rotary axis 32 a top portion of the latch tail 4. The rotary axis 32 includes two bearing stumps that protrude in opposite directions, one toward the shell 28 and one toward the other shell 29. The bearing stumps engage in bearing openings 30, 31 of the two housing shells 28, 29, so that the latch 2 is rotatably mounted in the lock housing 1.

The latch tail 4 and the latch head 3 are pivotably joined together by a pivot axis 5. Contained in a bearing pocket of the latch tail 4 is a pressure spring 8, which exerts a torque on the latch head 3. As a result, a stop 19 of the latch head 3 is spring-impacted adjacent to a counterstop 20 of the latch tail 4. In a non-impacted state the latch 2 thus behaves as a rigid body in which the latch head 3 is rigidly connected with the latch tail 4. However, if torque is exerted on the latch head 3 exceeding the spring tension of the spring 8, then the latch head 3 can pivot with respect to the latch tail 4.

Figure 2:
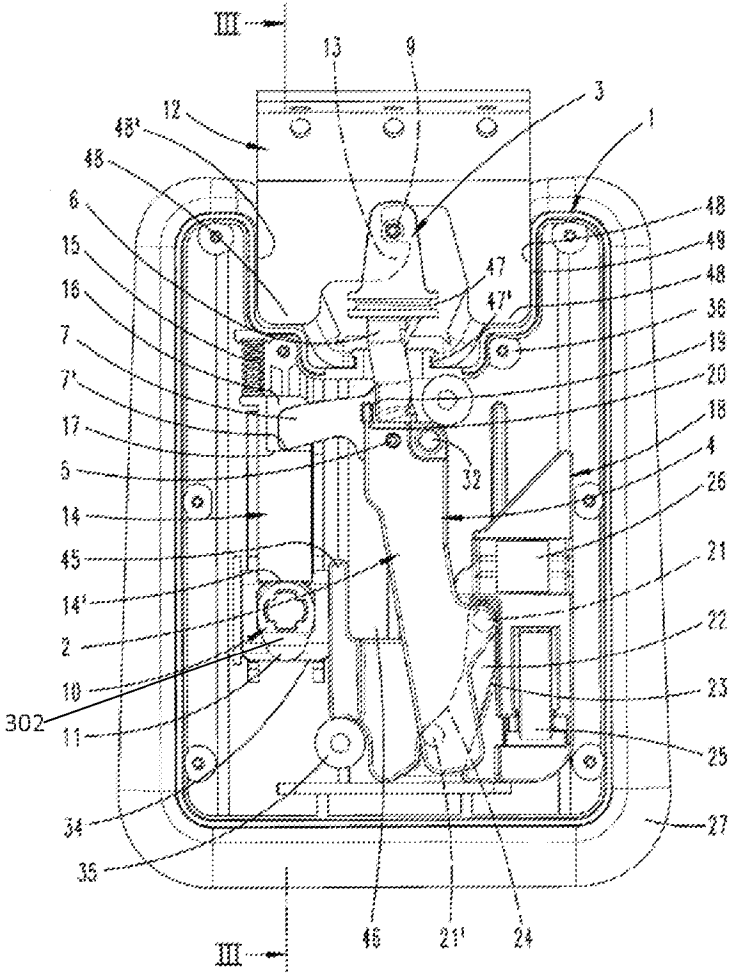
FIG. 2 shows the refuse container lock in opened state in the closed position.
Figure 3:
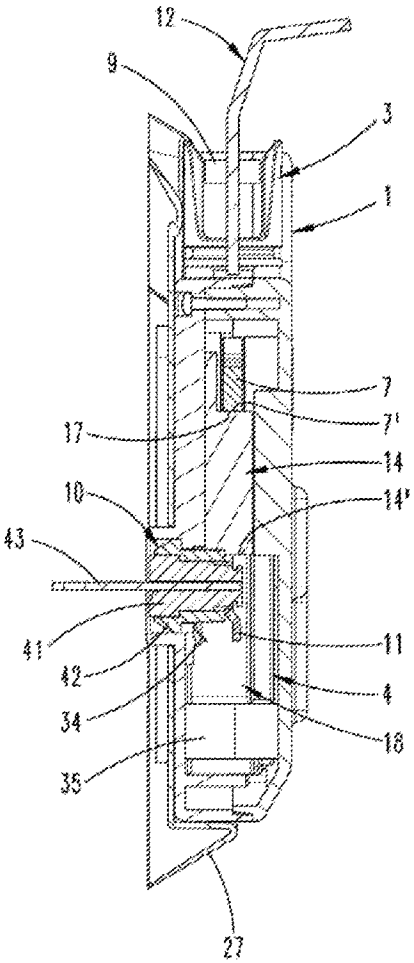
FIG. 3 shows a section along the line in FIG. 2.

A control cam 21, protruding from the latch tail 4 in the direction of shell 28, engages in a control recess 22 of the broad side of the opening slide 18. The control recess 22 has two control curves 23, 24 situated opposite one another, which are configured in such a way that they hold the latch tail 4 therebetween in the closed position illustrated in FIG. 4. The position shown in FIG. 2 is an upright position of the lock. If the lock is brought into the tipped position, then the opening slide 18 slides upwardly, by gravity, into the release position indicated in FIG. 6. At the same time, the control cam 21 slides along the control curve 23, which is configured so that the latch 2, particularly the latch tail 4 and the latch head 3, thereby pivots on the pivot axis 5. The sliding of the opening slide 18 allows the lock to be opened by gravity when the lock housing 1 is tipped into an inverted (tipped) position.

The latch head 3 has a locking arm 6, which extends at an angle of approximately 180 degrees to the latch tail 4. A locking stud 9 is situated at the end of the locking arm 6, which protrudes out of the lock housing 1.

A counterlocking part 12 may be affixed on the lid 402 of the container 400. As illustrated in FIG. 18, when the lock housing 1 is mounted on the outside of the container 400, counterlocking part 12 may also be mounted on the outside of the lid; and as illustrated in FIG. 19, when the lock housing 1 is mounted on the inside of the container 400, counterlocking part 12 is also mounted on the inside of the lid. The counterlocking part 12 may be a bent, stamped piece, e.g., a steel sheet, which can be affixed on the refuse container lid 402 with the aid of bolts or rivets protruding through the fastening openings. The counterlocking part 12 forms a hook 13, which when in the closed position engages the locking stud 9. The hook 13 is preferably configured as a catch-hook, which include a section that, on locking of the refuse container lid 402, interacts with the locking stud 9 in such a way to allow the latch head 3 to move with respect to the stationary latch tail 4. When the spring 8 is compressed, the latch head 3 moves away from the hook 13 to allow the locking stud 9 to disengage the hook 13. When the spring 8 is released, the latch head 3 moves toward the hook 13 to allow the locking stud 9 to be situated inside the hook 13 to lock the counterlocking part 12 to the lock housing 1.

The latch head 3 has a laterally downward-protruding actuation arm 7, which is configured to include an actuation 7'. A shoulder 17 of the actuation slide 14, which is situated opposite a bottom side 14', also cooperates with the actuation 7'. The length of the actuation slide 14 or the angle formed by the actuation arm 7 with respect to the locking arm 6, is configured in such a way that rotation of the locking cylinder 10, by rotation of the key 43, from the closed position shown in FIG. 2 to the release position shown in FIG. 4 leads to pivoting of the latch head 3 with respect to the latch tail 4, such that the pivot angle is sufficient to bring the locking stud 9 out of engagement with the hook 13. To accomplish this, the locking cylinder 10 is rotated, preferably approximately 180 degrees, to allow the lobe 302 of the locking cam 11 to locate below the bottom side 14' of the actuation slide and pushed it in an upward position. In the process, the spring 15 is compressed, the shoulder 17 pushes on the actuation 7' upwardly causing the latch head 3 to pivot relative to the latch tail 4. To revert to the closed position shown in FIG. 2, the locking cylinder 10 may be rotated to move the lobe 302 of the locking cam 11 away from the bottom side 14' of the actuation slide 14 to bring the latch head 3 back into its locked position. The operation of the actuation arm 7 and the actuation slide allows the lock to be opened with a key.

The actuation slide 14 configures a pocket 16 on its top side opposite the bottom side 14'. The floor of the pocket 16 forms the shoulder 17, which interacts with the actuation 7' of the actuation arm 7. The end of the actuation arm 7, which configures the actuation 7', is here contiguous with a side wall of the pocket 16. The angle-shaped edge of the pocket 16 has a centering pin 300 on which the spring 15 is placed. The guide rib 39 has an angle-shaped recess through which the actuation arm 7 protrudes.

Figure 6:
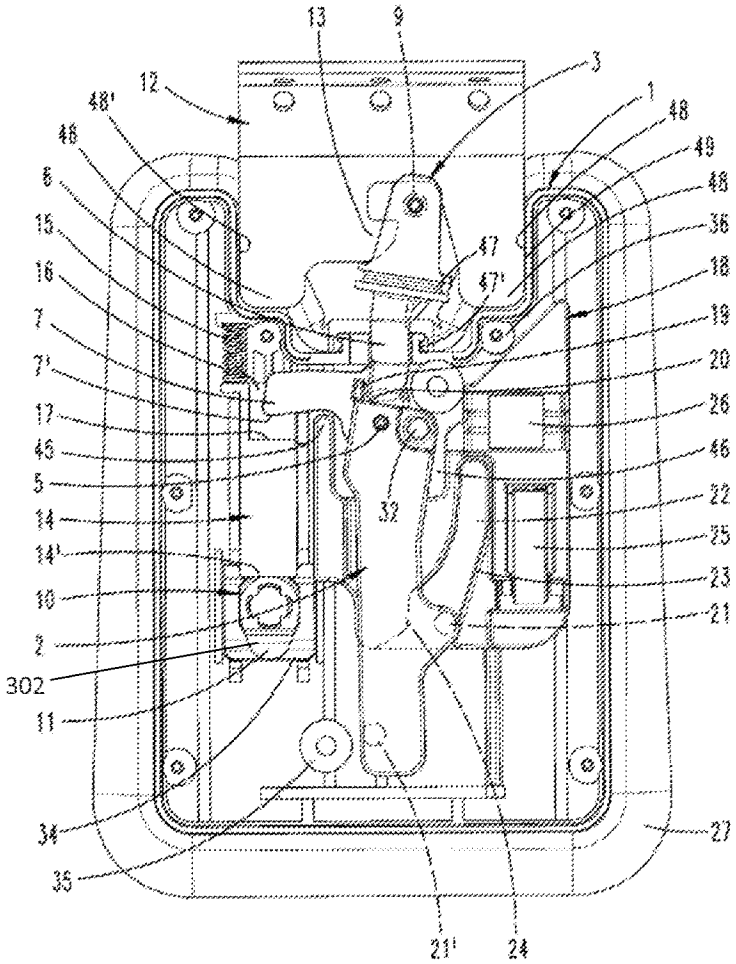
FIG. 6 shows a view according to FIG. 2 but with the latch in a gravity-powered release position in which an opening slide has shifted within the lock.
Figure 7:
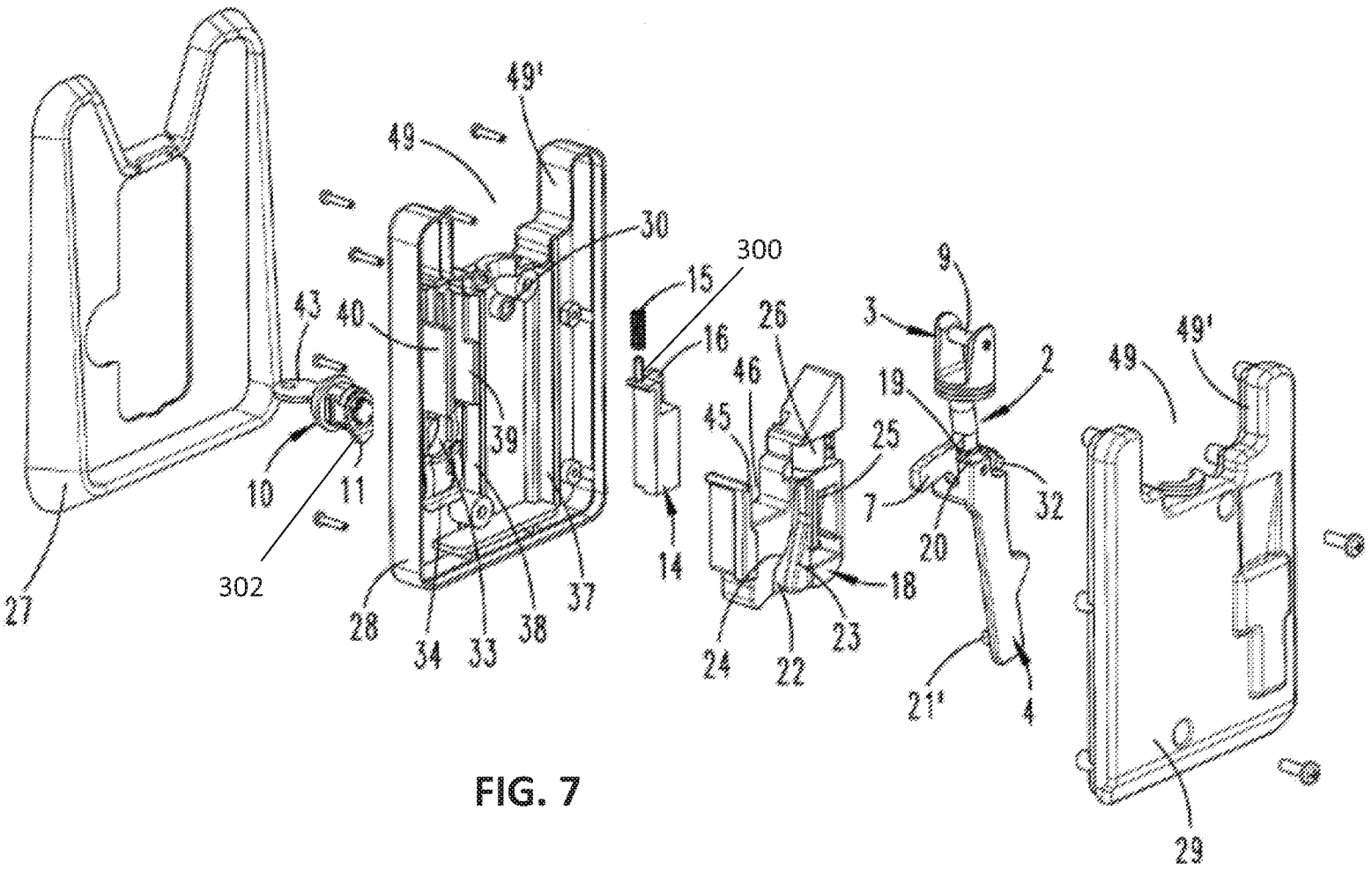
FIG. 7 shows a first exploded view of the refuse container lock.
Figure 8:
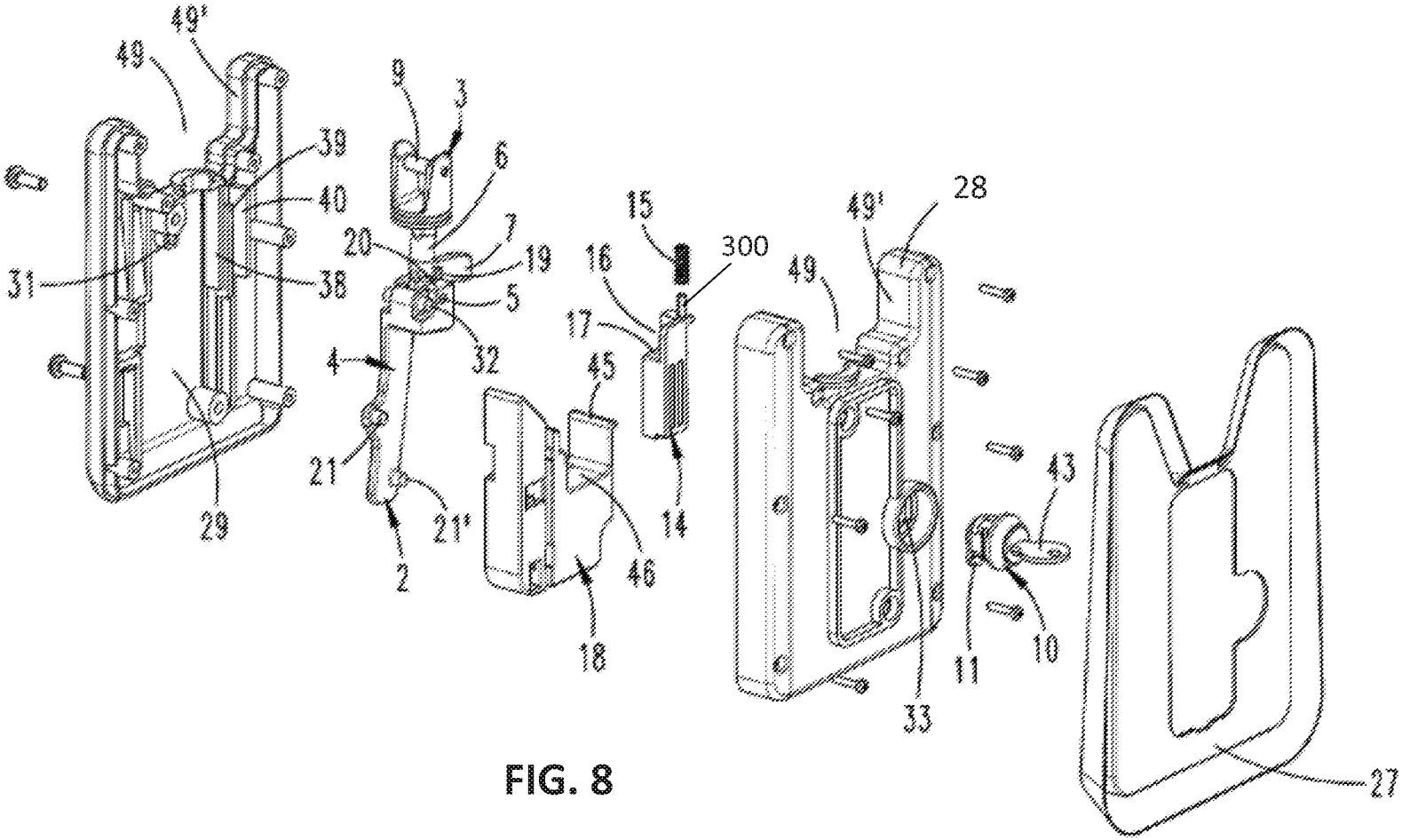
FIG. 8 shows a second exploded view of the refuse container lock.
Figure 9:
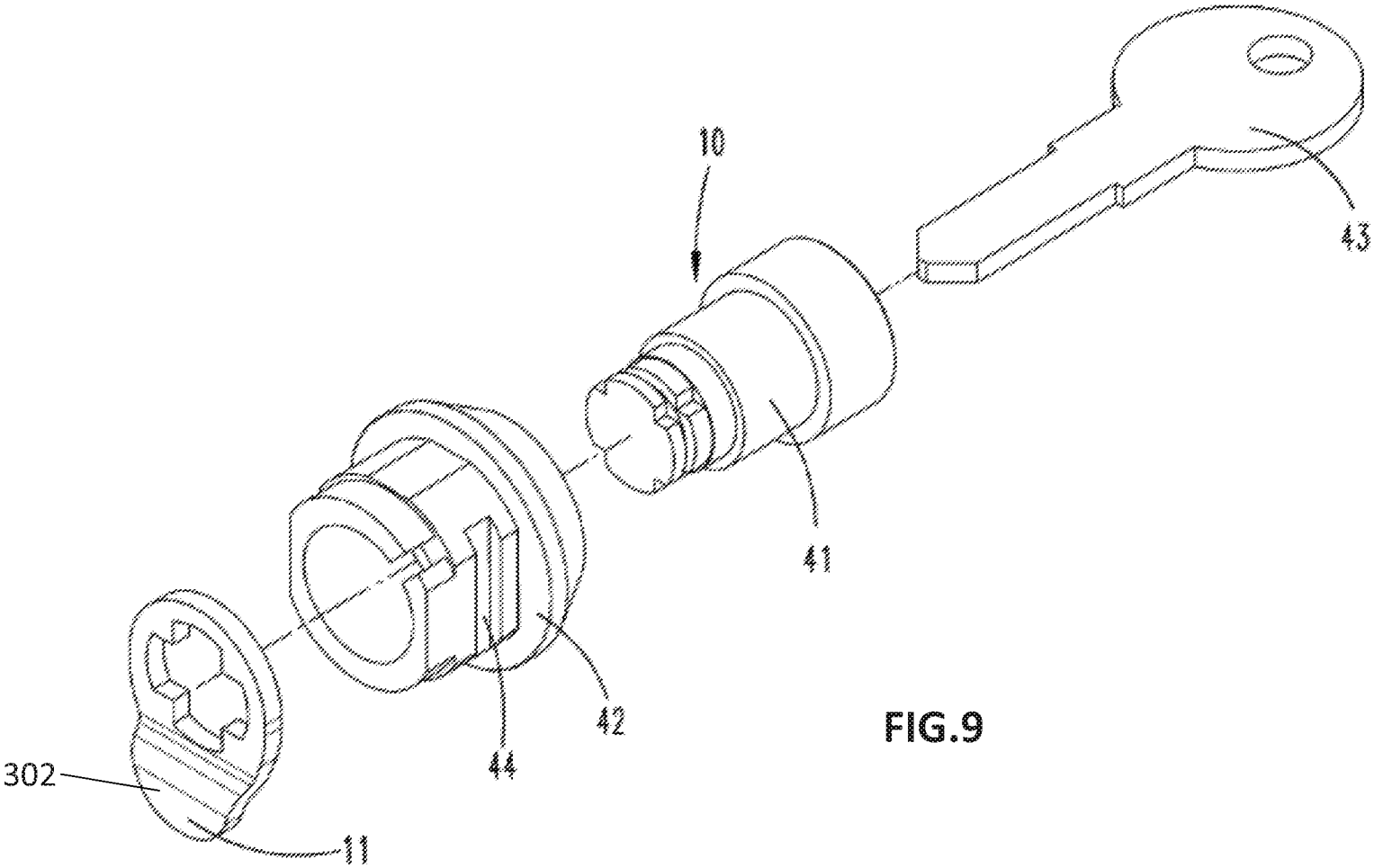
FIG. 9 shows an exploded view of the components of the locking cylinder.

The opening slide 18 includes a recess 46, which is flanked by a protrusion 45 and into which the bearing portion of the latch 2 can dip when the opening slide 18 is switched into the release position shown in FIG. 6. The protrusion 45 here follows may be located proximate to the pivoting actuation arm 7, so that protrusion 45, in theory, may acting on the actuation arm 7 for purpose of switching the latch head 3 into its release position.

With the refuse container lock, the blocking elements 25, 26 in patent DE 10 2007 039 351 A1 were already described, and therefore reference is made here to those comments. These blocking elements for operating errors 25, 26 have the task of ensuring that the opening slide 18 is switched by gravitational power into the release position only when the lock housing is tipped about a particular tipping axis. If the lock housing is rotated about another axis, then the blocking elements for operating errors 25, 26 are switched into a blocked position by gravitational force, so that the opening slide 18 cannot move into the release position. The opening slide 18 is switched by gravitational force within the lock housing 1 only when the lock housing 1 is moved about the tipping axis from the upright position shown in FIG. 2 to the tipped position seen in FIG. 6. The resulting pivoting of the latch 2 has the effect that the latch head 3 assumes the release position shown in FIG. 6. If the lock is moved back into the upright position, then gravity slides the opening slide 18 back into the position shown in FIG. 2. In this position the latch head 3 can pivot with respect to the latch tail 4 either by locking of the refuse container lid 402 or by key actuation.

Figure 4:
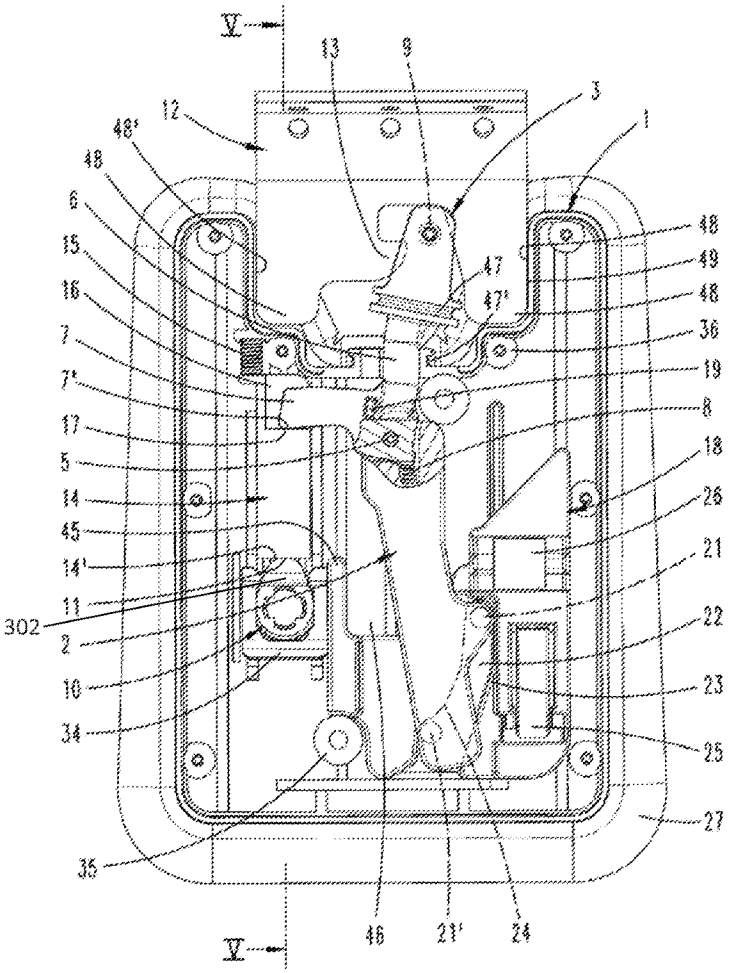
FIG. 4 shows a view as in FIG. 2 but with locking cylinder pivoted into an opening position, so that the latch assumes a release position.

The cam 21', extending from a bottom tip of the latch tail 4 in the direction of the shell 28 forms a blocking cam, which is in contact with a portion of the control curve 24 of the opening slide 18 in the operating positions illustrated in FIGS. 2 and 4. When the opening slide is slid into the operating position illustrated in FIG. 6, the blocking cam 21' detaches from the control curve 24, so that the latch 2 can rotate about the axis 32. On switching the opening slide 18 back into the position shown in FIG. 2 or 4, the blocking cam 21' impacts the opening slide 18 when the opening slide 18 is pivoted slid back into its position illustrated in FIG. 2 or 4.

Reference number 47 or 47' refers to recessed rings on the housing or on the latch head 3. A gasket ring may be clipped into these recessed rings 47 or 47' to protect the inside of the housing 1 from dust. The pleated hose then surrounds the portion of the locking arm 6 extending out of the housing opening.

The portion of the counterlocking part 12 that configures the hook 13 forms two border portions 48' that run parallel to one another. These two border portions 48' end in continuations 48, which dip into a reception shaft 49 of the housing 1 when the refuse container lid 402 closes. The two lateral walls 49' of the reception shaft run parallel to one another. With the refuse container in closed position, the borders portions 48' are adjacent to the lateral walls 49'. The corners of the continuations 48 or of the reception shaft 49 are preferably rounded. On locking the refuse container lid 402, the rounded corners can meet one another when the continuations 48 enter the reception shaft 49.

Figure 10:
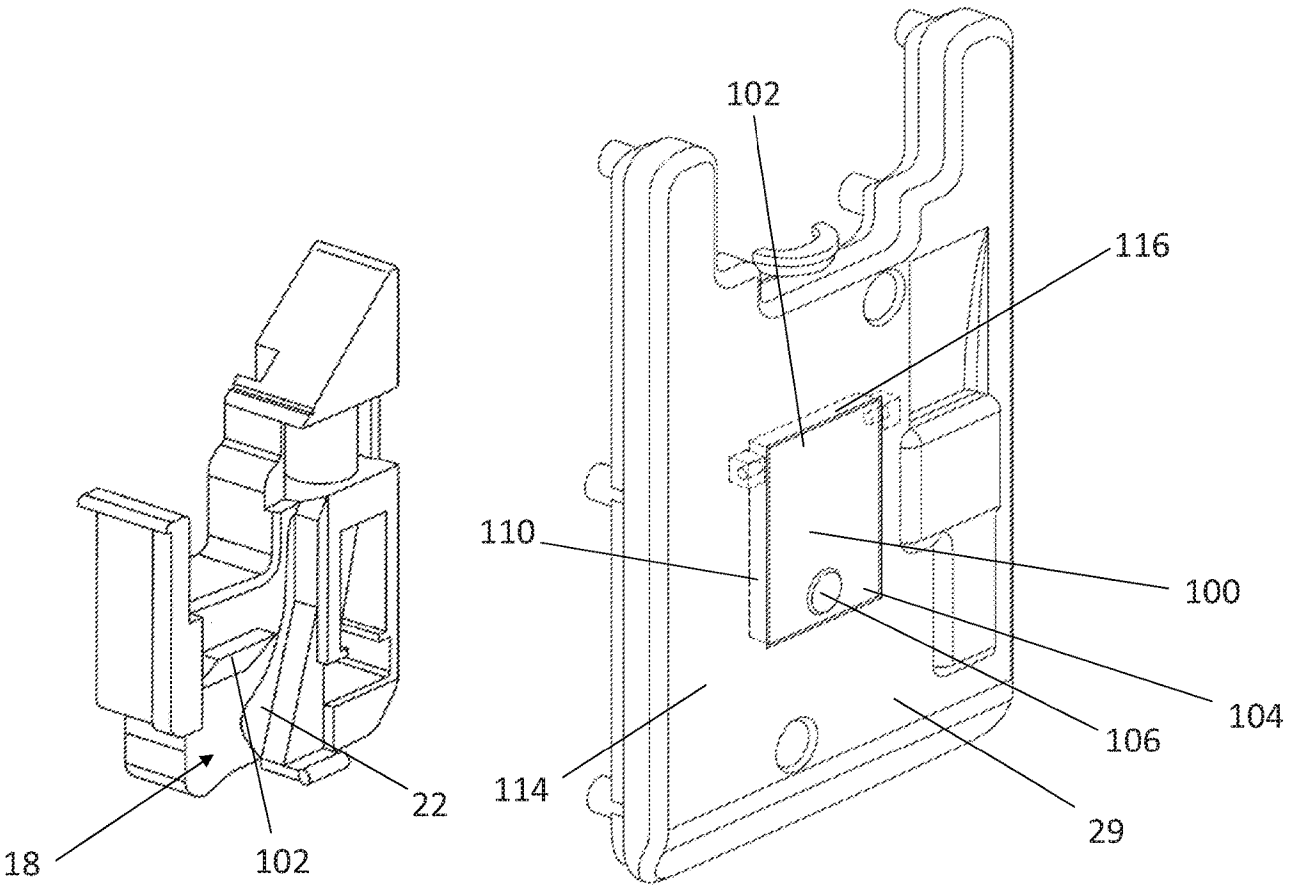
FIG. 10 shows an exploded view of the opening slide containing a ledge and the shell containing a paddle.
Figure 11:
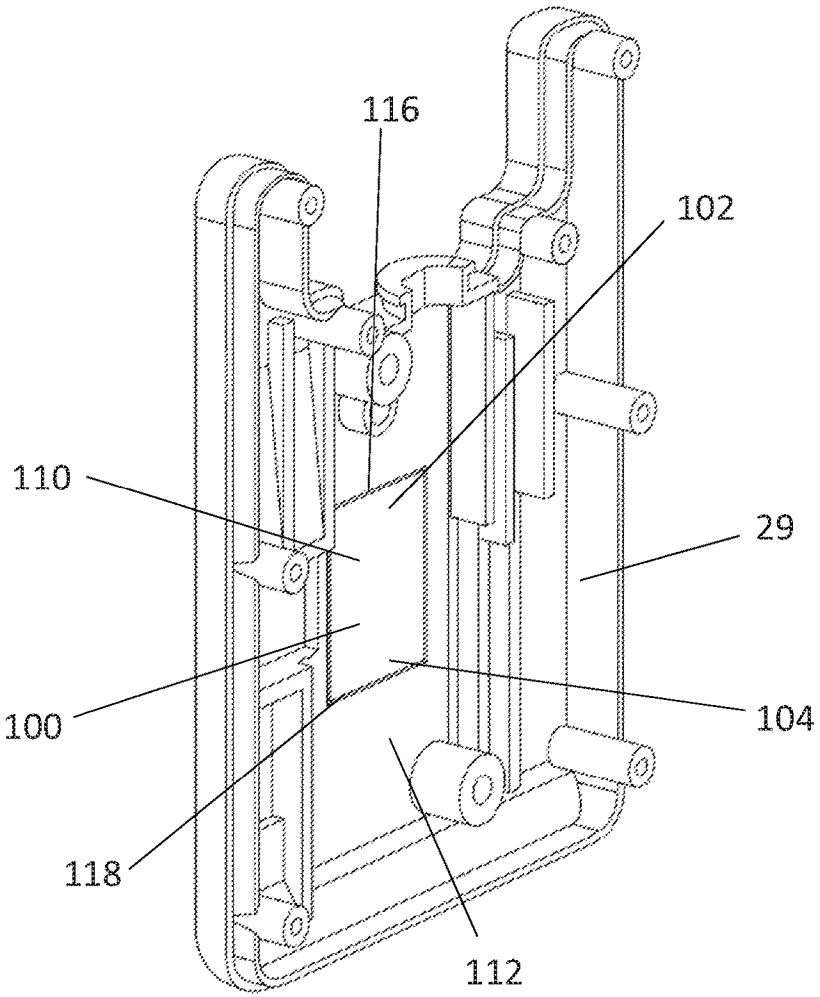
FIG. 11 shows a view of the inside of the shell containing a paddle.

In certain embodiments, the lock may include an impact detection paddle 100 mounted on the shell 29 of the housing 1. The paddle 100 provides a mechanical impact sensor that can detect whether the lock has been unintendedly tipped over in a forward direction (a direction away from the shell 29 and toward the shell 27) or whether it is being tipped over, such as for dumping. In an exemplary embodiment, as best illustrated in FIGS. 10-13, the paddle 100 is preferably a rectangular bar mounted in a recess 110 on an inner surface 112 of the shell 29. The recess 110 is preferably formed as an indentation in the inner surface 112 of the shell 29. The indentation may protrude outwardly on the outer surface 114 of the shell 29. The paddle 100 is preferably mounted within the recess 110, such that an inner facing surface of the paddle 100 is substantially flush with the inner surface 112 of the shell 29 when in the non-impact position. The paddle contains a first end 102 that is pivotally mounted, such as by pins received in associated detents as best shown in FIG. 10, at a top 116 of the recess 110 (when the lock is in its upright position), and a second end 104 that is detachably mounted to a bottom 118 of the recess 110. The paddle 100 preferably fits loosely within the recess 110 so that, when the second end 104 of the paddle 100 is detached from the recess 110 it can freely swing without friction against the sides of the recess 110.

The first end 102 may be mounted in the recess with a rotatable coupling, such as a hinge, to allow the paddle 100 to pivot on its first end 102. The second end 104 of the paddle 100 is detachably retained in the recess by a bias force to prevent the paddle 100 from rotating away and detaching from the recess unless a force greater than the bias force is introduced. In an exemplary embodiment, the bias force to keep the paddle from rotating away and detach from the lever is magnetic. In that case, a magnet 106 may be placed at or about the bottom 118 of the recess and a ferromagnetic material is used for the paddle 100 to magnetically hold the paddle 100 and prevent paddle 100 from rotating away from the recess 110. Alternatively, the magnet 106 may be placed in the recess 110 and a ferromagnetic material placed on the second end 104 of the paddle 100 (if the paddle 100 is not made of a ferromagnetic material). A person skilled in the art would understand that various ways are available to magnetically attach the second end 104 of the paddle 110 to the recess 110. For example, although the magnet is shown in the drawings as being located in the recess 110, the magnet 106 may be on the paddle 100, as long as the magnet 106 is capable of holding the second end 104 in the recess 110. When a force greater than the magnetic force is introduced, such as a sudden jerk or jarring, e.g., by ground impact, the second end 104 the paddle 100 will pull away from the recess 110 by pivoting on the rotatable coupling at the first end 102. Preferably, the magnetic force is not sufficient to prevent the paddle 100 from rotating away from the recess 110 when the lock is knocked over on its side and impacts the ground in the forward direction.

Figure 12:
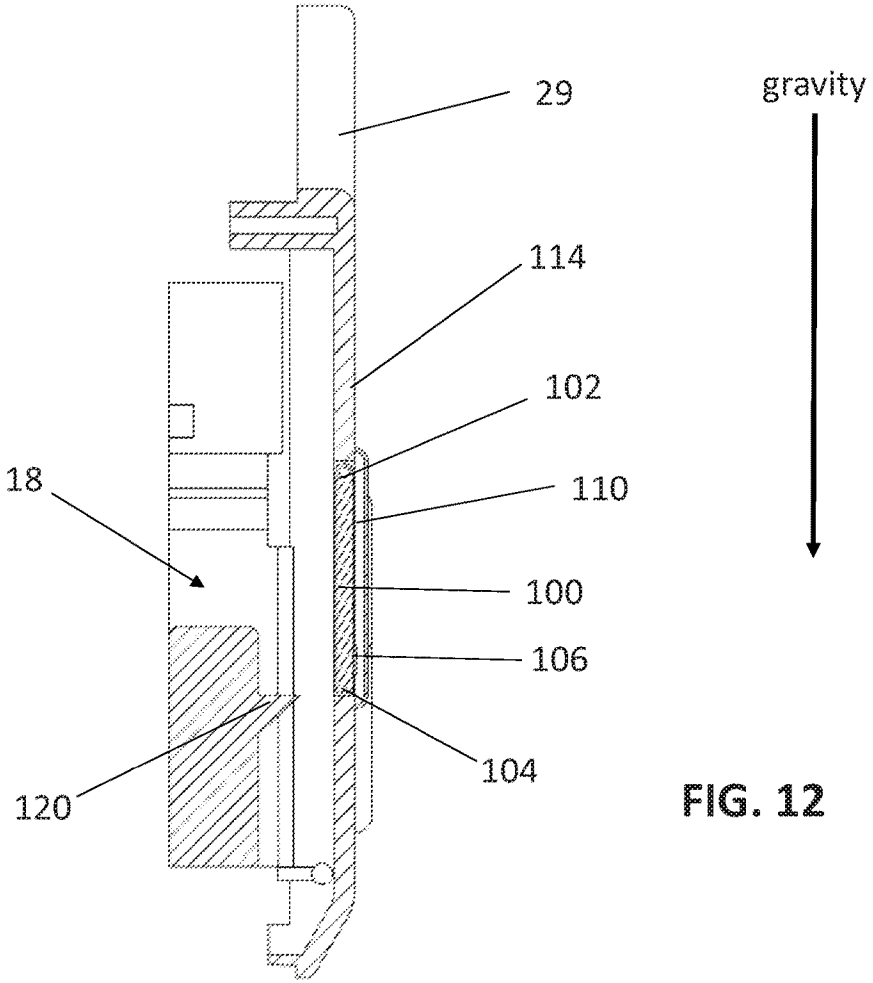
FIG. 12 shows a cross-section of the opening slide and shell where the paddle is inside the recess.
Figure 13:
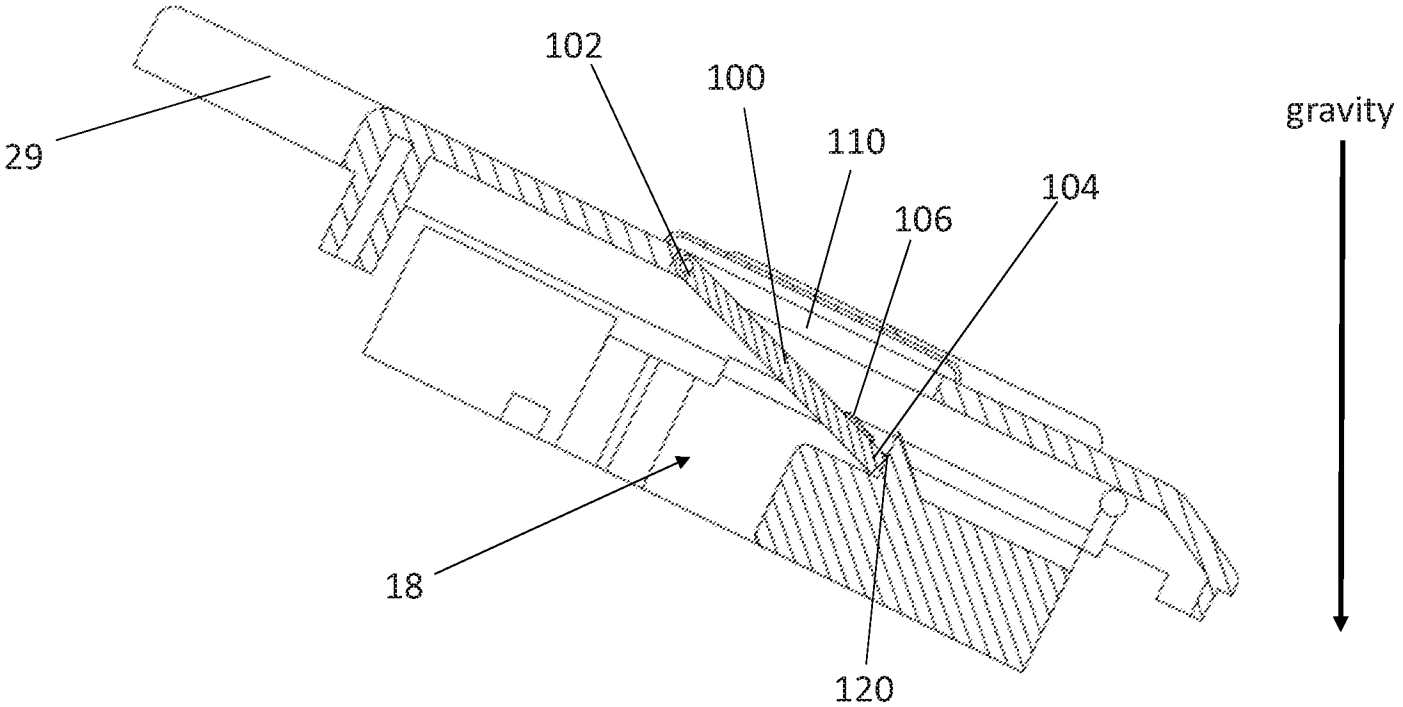
FIG. 13 shows a cross-section of the opening slide and shell where the paddle is rotated away from the recess and lodges on the ledge.
Figure 14:
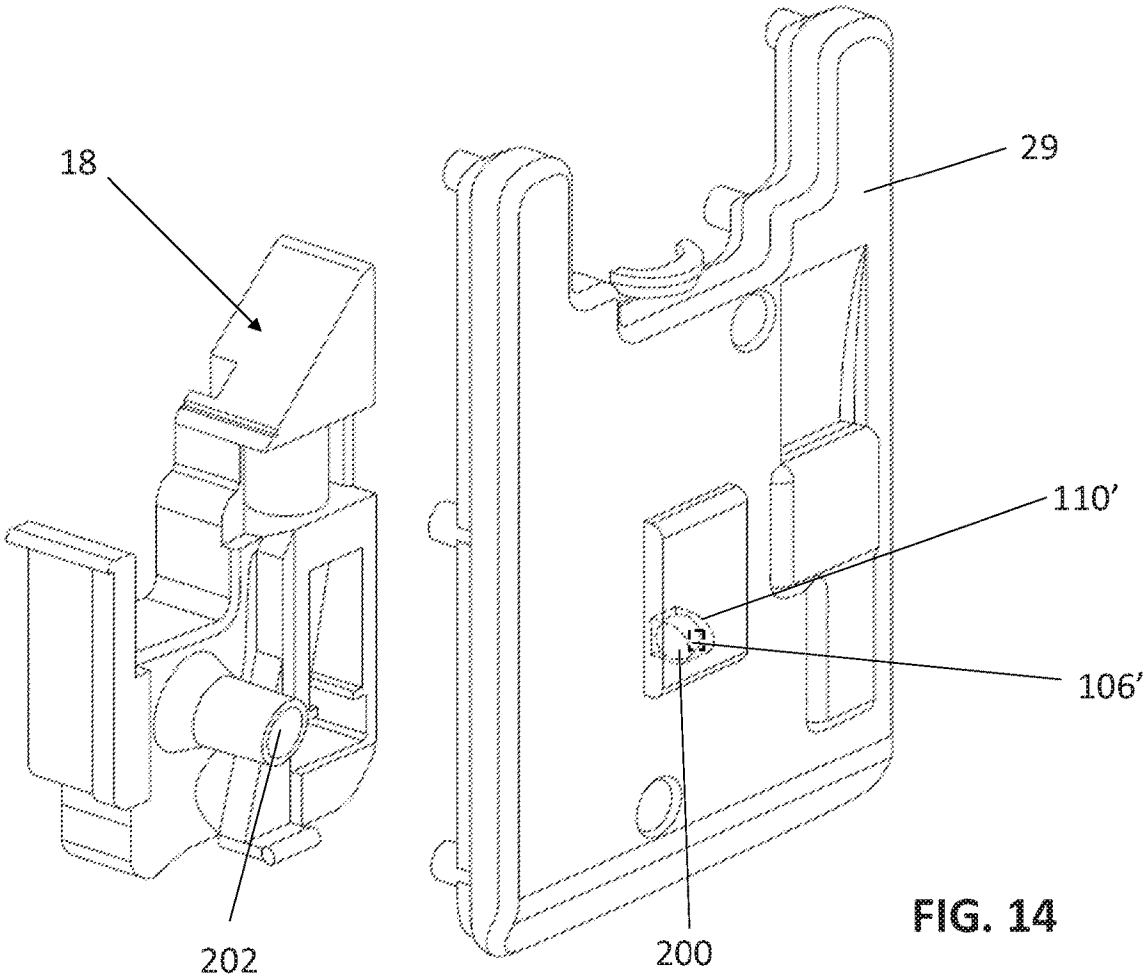
FIG. 14 shows an exploded view of the opening slide containing a cavity and the shell containing a rolling member.
Figure 15:
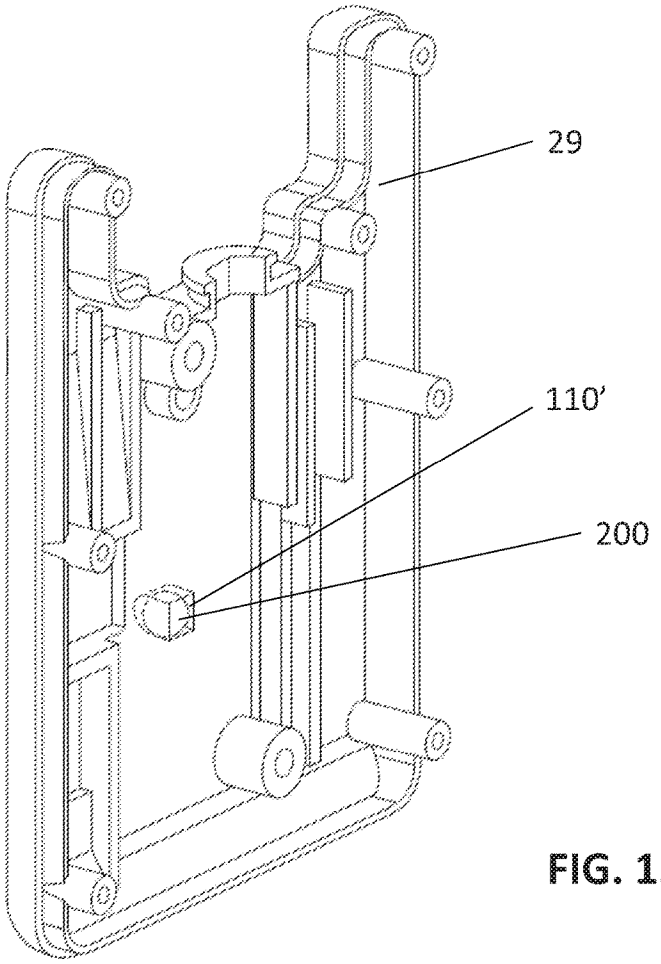
FIG. 15 shows a view of the inside of the shell containing a rolling member.
Figure 16:
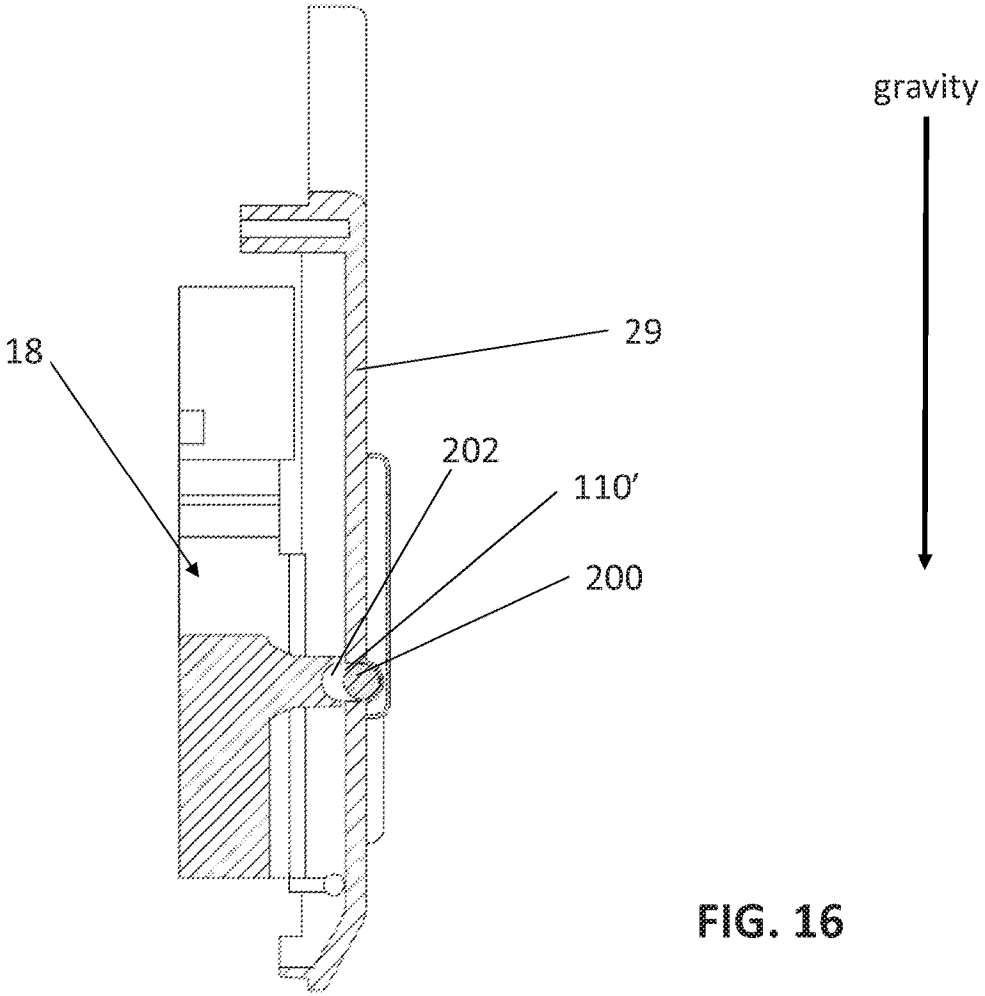
FIG. 16 shows a cross-section of the opening slide and shell where the rolling member is inside the recess.

To cooperate with the paddle 100, the opening slide 18 contains a ledge 120 adjacent to the control recess 22, as best shown in FIG. 12. The ledge 120 faces the paddle 100 and is positioned such that when the paddle 100 detaches from and swings away from the recess 110, the second end 104 of the paddle 100 makes contact with the upper side of the ledge 120. In that position, as shown in FIG. 13, the paddle 100 prevents the opening slide 18 from sliding upwardly into the release position. Thus, when the paddle 100 is detached from the recess 110 and makes contact with the ledge 120, the lock cannot be released to open the refuse container.

With the paddle 100 and the ledge 120, the lock contains a mechanical impact sensor that can detect whether the container 10 has been unintendedly tipped over in the forward direction or whether it is being tipped over, such as for dumping. For example, as best illustrated in FIG. 13, when the refuse container (and thus the lock) is knocked over in the forward direction, e.g. by strong wind or animals, it remains locked. The jerking or jarring action, such as by ground impact, on the refuse container, actuates the paddle 100 such that the second end 104 is detached from the recess 110, and the paddle 100 pivots away from the recess 110 by gravity and abuts against the ledge 120 on the opening slide 18. As best shown in FIG. 13, the abutment between the paddle 100 and the ledge 120 prevents the opening slide 18 from being pushed into the release position.

On the other hand, when the refuse container is turned over for dumping without a jerking or jarring motion, the second end 104 of the paddle 100 remains attached inside the recess 110. That allows the opening slide 18 to freely slide into the release position to allow the container to be opened.

In other embodiments, instead of the paddle 100, as illustrated in FIGS. 14-17, the recess 110' in the shell 29 may contain a rolling member 200. In this case, the recess 110' is shaped slightly (preferably no more than 5%) larger than the rolling member 200, so that the rolling member 200 may roll away from the recess 110' toward the opening slide 18. The rolling member 200 may be in the form of a spherical ball. Alternatively, the rolling member 200 may be in the form of a cylindrical disc, capable of rolling within the recess 110'. It will be appreciated that a diameter of the rolling member 200 is such that it can roll away from the recess 110'. The rolling member is detachably retained in the recess 110', e.g. by a magnet 106', in a similar manner as the second end 104 of the paddle being attached in the recess 110. The magnet 106' may be in the recess 110' and a ferromagnetic material is used for the rolling member 200 to magnetically hold the rolling member 200 in the recess 110'. Alternatively, the magnet 106' may be on the rolling member 200 and a ferromagnetic material placed in the recess 110'. A person skilled in the art would understand that various ways are available to magnetically couple the rolling member 200 to the recess 110'. When a force greater than the magnetic force is introduced, such as a sudden jerk or jarring, e.g., by ground impact, the rolling member 200 may pull away from the recess 110' and roll toward the opening slide 18. Preferably, the magnetic force is not sufficient to prevent the rolling member 200 from rolling away from the recess 110' when the lock is knocked over on its side and impacts the ground in the forward direction.

Figure 17:
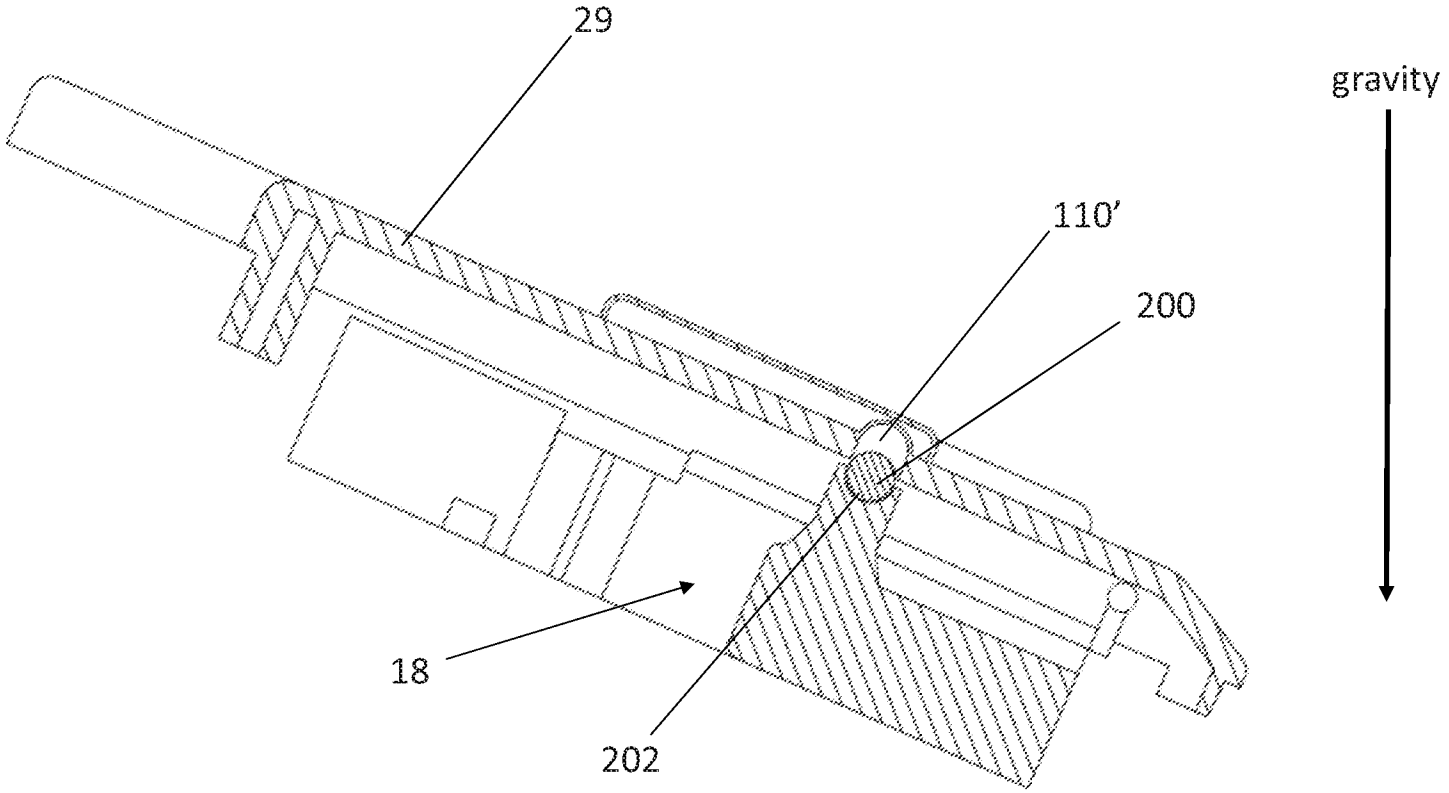
FIG. 17 shows a cross-section of the opening slide and shell where the rolling member is rolls away from the recess and wedges in the cavity.

With the rolling member 200, the opening slide 18, instead of the ledge 120, contains a cavity 202 that can partially accommodate a portion of the rolling member 200. When the rolling member 200 rolls away from the recess 110', e.g., due to gravity and ground impact, it contacts and partially wedges in the cavity 202. It will be appreciated that the rolling member 200 should be sufficiently large, such that when it is wedged in the cavity 202, part of the rolling member remains in the recess 110', as illustrated in FIG. 17.

With the rolling member 200 and the cavity 202 on the opening slide, the lock contains a mechanical impact sensor that can detect whether the container 10 has been unintendedly tipped over in the forward direction or whether it is being tipped over, such as for dumping. For example, as best illustrated in FIG. 17, when the refuse container 10 (and thus the lock) is knocked over in the forward direction, e.g. by strong wind or animals, it remains locked. The jerking or jarring action, such as by ground impact, on the refuse container, knocks the rolling member 200 loose such that gravity pulls it away from the recess 110' toward the opening slide 18. On contact with the opening slide 18, the rolling member 200 is wedged in the cavity 202 while it is still partially inside the recess 110'. As best shown in FIG. 17, that position of the rolling member prevents the opening slide 18 from being pushed into the release position.

On the other hand, when the refuse container is turned over for dumping without a jerking or jarring motion, the rolling member 200 remains attached inside the recess 110'. That allows the opening slide 18 to freely slide into the release position to allow the container to be opened.

In the same manner as the paddle 100 and/or the rolling member 200, the blocking elements for operating errors 25, 26 may also be detachably retained, e.g. by a magnet. That way, the lock is able to keep the lid 402 closed, when the container 10 falls over and impacts the ground in any direction. Here, the magnet allows the lock to open, for example for dumping in any direction, unless when a force greater than the magnetic force, such as a sudden jerk or jarring, e.g., by ground impact, is experienced. The blocking elements for operating errors 25, 26 may also be designed to operate similarly to the paddle 100 or rolling element 200 described above, albeit in different directions. For example, the paddle 100 or rolling element 200 may operate to block opening of the container when it falls forward, while the blocking elements block opening when the container falls backward or to either side.

The foregoing description of the preferred embodiments of the present invention has been presented for the purpose of illustration in accordance with the provisions of the Patent Statutes. It is not intended to be exhaustive or to limit the invention to the precise forms disclosed. Other modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes may be made in the above-described invention without departing from the intent and scope thereof. It is also intended that the scope of the present invention be defined by the claims appended thereto.

What is claimed is:

1. A refuse container lock comprising:

a lock housing;

a latch mounted in the lock housing and comprises a latch head and a latch tail, the latch head protruding outside of the lock housing and, when in a closed position, is configured to engage a hook of a counterlocking part, and positionable into a release position by tipping the lock housing from an upright position into a tipped position;

an opening slide mounted in the lock housing and slidable between a closed position and a tipped position by gravity acting on the opening slide, wherein, when the opening slide is in the tipped position, the latch tail is rotated to pivot the latch head into the release position, and when the opening slide is in the closed position, the opening slide is kept in a position that holds the latch head in the closed position;

a paddle having a first end and a second end; and a magnet associated with the housing or the paddle, wherein the first end of the paddle is pivotally mounted to the housing and the second end of the paddle is detachably retained on the housing by the magnet, the second end of the paddle, when detached from the housing, is configured to cooperate with a ledge on the opening slide to prevent the opening slide from rotating the latch tail.

2. The refuse container lock of claim 1, wherein the paddle is housed in a recess in the housing.

3. The refuse container lock of claim 1, wherein the paddle provides a mechanical impact sensor that, when activated, blocks movement of the opening slide.

4. The refuse container lock of claim 3, wherein the paddle is activated when the second end of the paddle is rotated away from the housing.

5. The refuse container lock of claim 1, wherein the paddle is mounted in a recess in the housing.

6. The refuse container lock of claim 5, wherein when the second end of the paddle detaches from the housing, it rests on the ledge on the opening slide to prevent the opening slide from rotating the latch tail.

7. The refuse container lock of claim 1, further comprising a blocking element detachably retained on the opening slide by a magnet, and designed to detach from the opening slide in a direction different from the paddle.

8. The refuse container lock of claim 1, further comprising a locking cylinder actuable to put the latch head into the release position by the action of a locking cam of the locking cylinder upon the latch head which is coupled to the latch tail which is held immovably in the upright position so as to pivot contrary to an elastic return force, the locking cylinder is situated in the lock housing and the locking cam acts on an actuation arm extending down from the latch head.

9. A refuse container lock, comprising:

a lock housing;

a latch mounted in the lock housing and comprises a latch head and a latch tail, the latch head protruding outside of the lock housing and, when in a closed position, is configured to engage a hook of a counterlocking part, and positionable into a release position by tipping the lock housing from an upright position into a tipped position;

an opening slide mounted in the lock housing and slidable between a closed position and a tipped position by gravity acting on the opening slide, wherein, when the opening slide is in the tipped position, the latch tail is rotated to pivot the latch head into the release position, and when the opening slide is in the closed position, the opening slide is kept in a position that holds the latch head in the closed position;

a rolling member; and a magnet associated with the housing or the rolling member; wherein the rolling member is detachably retained on the housing by the magnet, when detached from the housing, the rolling member is configured to cooperate with a cavity on the opening slide to prevent the opening slide from rotating the latch tail.

10. The refuse container lock of claim 9, wherein the rolling member is a ball.

11. The refuse container lock of claim 9, wherein the rolling member is detachably retained in a recess of the housing.

12. The refuse container lock of claim 11, wherein when the rolling member is detached from the recess, it is partially retained in the recess and partially lodged in the cavity on the opening slide.

13. The refuse container lock of claim 9, wherein the rolling member provides a mechanical impact sensor that, when activated, blocks movement of the opening slide.

14. The refuse container lock of claim 13, wherein the rolling member is activated when the rolling member detaches from the housing.

15. The refuse container lock of claim 9, further comprising a blocking element detachably retained on the opening slide by a magnet, and designed to detach from the opening slide in a direction different from the rolling member.

16. The refuse container lock of claim 9, further comprising a locking cylinder actuable to put the latch head into the release position by the action of a locking cam of the locking cylinder upon the latch head which is coupled to the latch tail which is held immovably in the upright position so as to pivot contrary to an elastic return force, the locking cylinder is situated in the lock housing and the locking cam acts on an actuation arm extending down from the latch head.

17. A refusing container comprising a container and the lock of claim 1 attached thereto.

18. A method for making a waste container, comprising the steps of:

a) providing a container; and b) mounting the container lock of claim 1 to a wall of the container.

19. A refusing container comprising a container and the lock of claim 10 attached thereto.

20. A method for making a waste container, comprising the steps of:

a) providing a container; and b) mounting the container lock of claim 9 to a wall of the container.

* * * * *